US008741527B2

(12) United States Patent
Inaba et al.

(10) Patent No.: US 8,741,527 B2
(45) Date of Patent: Jun. 3, 2014

(54) LIQUID DEVELOPER, DEVELOPER CARTRIDGE, PROCESS CARTRIDGE, IMAGE FORMING APPARATUS, AND IMAGE FORMING METHOD

(75) Inventors: Yoshihiro Inaba, Kanagawa (JP); Akira Imai, Kanagawa (JP); Daisuke Yoshino, Kanagawa (JP); Takako Kobayashi, Kanagawa (JP); Koji Horiba, Kanagawa (JP); Takahiro Ishizuka, Kanagawa (JP); Masahiro Oki, Kanagawa (JP); Ryosaku Igarashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/338,711

(22) Filed: Dec. 28, 2011

(65) Prior Publication Data

US 2013/0078568 A1 Mar. 28, 2013

(30) Foreign Application Priority Data

Sep. 27, 2011 (JP) ..... 2011-211520

(51) Int. Cl.
*G03G 9/08* (2006.01)

(52) U.S. Cl.
USPC ..... 430/116; 430/112; 430/114; 430/117.1

(58) Field of Classification Search
USPC ..... 430/112, 114, 116, 117.7
See application file for complete search history.

(56) References Cited

U.S. PATENT DOCUMENTS

| | | | | |
|---|---|---|---|---|
| 4,155,862 | A * | 5/1979 | Mohn et al. | 430/113 |
| 4,250,241 | A * | 2/1981 | Tsubuko et al. | 430/114 |
| 4,840,863 | A | 6/1989 | Otsu et al. | |
| 5,352,557 | A | 10/1994 | Matsuoka et al. | |
| 6,190,816 | B1 | 2/2001 | Takehara et al. | |
| 2006/0046174 | A1 * | 3/2006 | Ohki et al. | 430/108.4 |
| 2008/0003516 | A1 * | 1/2008 | Akioka et al. | 430/113 |
| 2012/0141933 | A1 * | 6/2012 | Inaba et al. | 430/114 |
| 2012/0189954 | A1 * | 7/2012 | Horiba et al. | 430/117.1 |

FOREIGN PATENT DOCUMENTS

| | | |
|---|---|---|
| JP | A-63-060458 | 3/1988 |
| JP | A-06-175414 | 6/1994 |
| JP | A-07-84407 | 3/1995 |

(Continued)

*Primary Examiner* — Mark F Huff
*Assistant Examiner* — Rachel Zhang
(74) *Attorney, Agent, or Firm* — Oliff PLC

(57) ABSTRACT

A liquid developer includes: a carrier liquid; and toner particles that are dispersed in the carrier liquid and that includes a styrene-based thermoplastic elastomer, a styrene-based thermoplastic resin, and a quaternary ammonium base-containing polymer having a constituent unit expressed by Chemical Formula I:

Chemical Formula I wherein $R^1$ represents hydrogen or an alkyl group with a carbon number equal to or less than 3, $R^2$ represents an alkylene group with a carbon number equal to or less than 18, $R^3$ to $R^5$ represent an alkyl group or an aralkyl group with a carbon number equal to or less than 18, X represents —COO— or —CONH—, and $Y^-$ represents a halogen ion or an anion having a —COO— group or a —$SO_3$— group in the structure thereof.

7 Claims, 1 Drawing Sheet

(56) References Cited

FOREIGN PATENT DOCUMENTS

| | | |
|---|---|---|
| JP | A-11-184149 | 7/1999 |
| JP | A-2000-181141 | 6/2000 |
| JP | A-2000-292987 | 10/2000 |
| JP | A-2001-175031 | 6/2001 |
| JP | A-2007-079348 | 3/2007 |

* cited by examiner

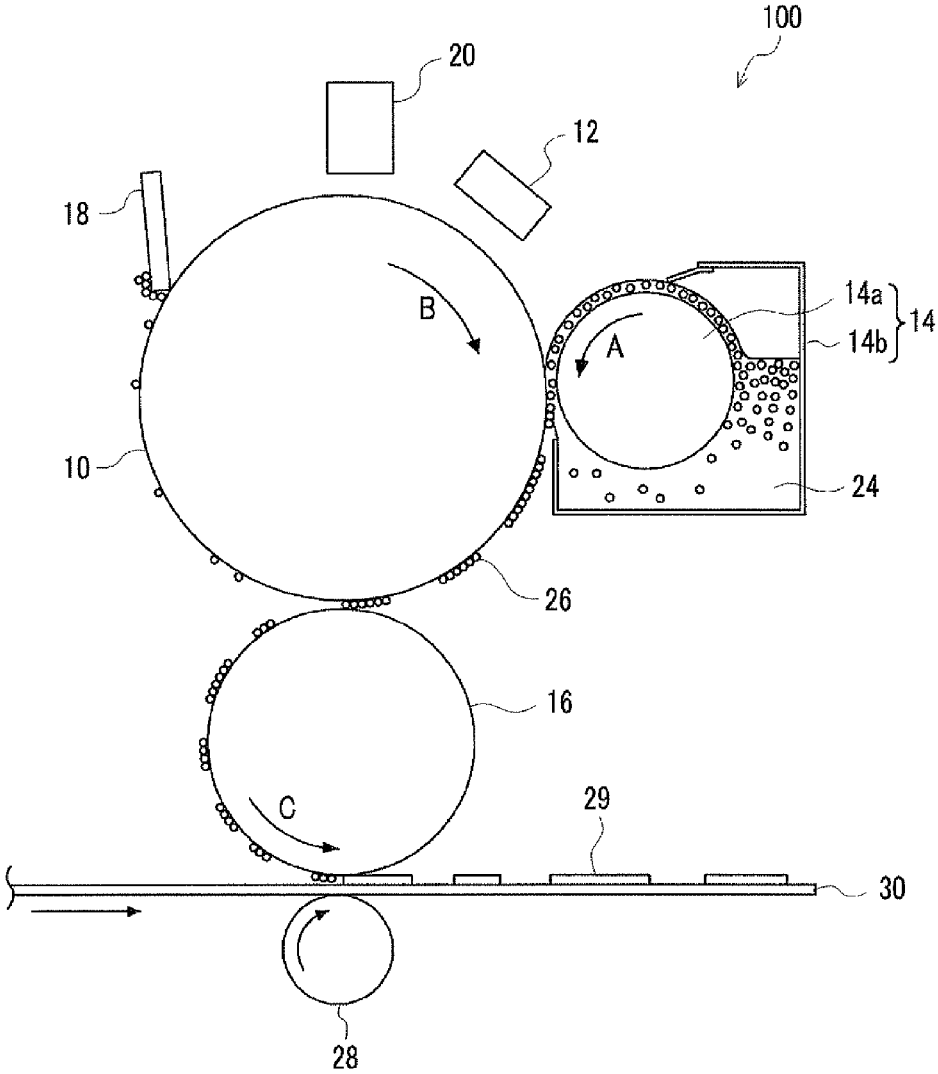
100
20
12
18
B
A
14a
14
14b
10
24
26
16
C
29
30
28

LIQUID DEVELOPER, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-211520 filed Sep. 27, 2011.

BACKGROUND

1. Technical Field

The present invention relates to a liquid developer, a developer cartridge, a process cartridge, an image forming apparatus, and an image forming method.

2. Related Art

For example, various toners have been proposed as a toner used in a dry developing system.

SUMMARY

According to an aspect of the invention, there is provided a liquid developer including: a carrier liquid; and toner particles that are dispersed in the carrier liquid and that includes a styrene-based thermoplastic elastomer a styrene-based thermoplastic resin, and a quaternary ammonium base-containing polymer having a constituent unit expressed by Chemical Formula I.

Chemical Formula I

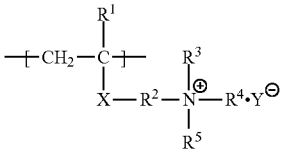

In Chemical Formula I, $R^1$ represents hydrogen or an alkyl group with a carbon number equal to or less than 3, $R^2$ represents an alkylene group with a carbon number equal to or less than 18, $R^3$ to $R^5$ represent an alkyl group or an aralkyl group with a carbon number equal to or less than 18, X represents —COO— or —CONH—, and $Y^-$ represents a halogen ion or an anion having a —COO— group or a —$SO_3$— group in the structure thereof.

BRIEF DESCRIPTION OF THE DRAWINGS

Exemplary embodiments of the present invention will be described in detail based on the following FIGURE, wherein:

FIG. 1 is a diagram schematically illustrating the configuration of an example of an image forming apparatus according to an exemplary embodiment of the invention.

DETAILED DESCRIPTION

Hereinafter, exemplary embodiments of the invention will be described in detail.

Liquid Developer

A liquid developer according to an exemplary embodiment of the invention includes a carrier liquid and toner particles that are dispersed in the carrier liquid and that includes a styrene-based thermoplastic elastomer, a styrene-based thermoplastic resin, and a quaternary ammonium base-containing polymer having a constituent unit expressed by Chemical Formula I.

Chemical Formula I

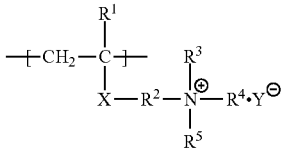

In Chemical Formula I, $R^1$ represents hydrogen or an alkyl group with a carbon number equal to or less than 3, $R^2$ represents an alkylene group with a carbon number equal to or less than 18, $R^3$ to $R^5$ represent an alkyl group or an aralkyl group with a carbon number equal to or less than 18, X represents —COO— or —CONH—, and $Y^-$ represents a halogen ion or an anion having a —COO— group or a —$SO_3$— group in the structure thereof.

In the liquid developer, toner particles including the styrene-based thermoplastic binder resin are dispersed in the carrier liquid. In the liquid developer, by causing the toner particles to include a styrene-based thermoplastic elastomer, flexibility is given to a binder resin and thus a bending-resistance characteristic (crease characteristic) in the obtained image is improved. By causing the toner particles to include a styrene-based thermoplastic resin, a scratch-resistance characteristic (scratch characteristic) in the obtained image is improved.

However, when a toner including the styrene-based thermoplastic elastomer or the styrene-based thermoplastic resin is used, fluidity may be lowered in an attempt to raise the solid concentration of the liquid developer. In addition, grindability during producing the liquid developer may be lowered and the lowering in the grindability tends to be marked, particularly, as the molecular weight of the styrene-based thermoplastic resin to be included becomes higher and as a pigment concentration becomes higher.

On the contrary, in the liquid developer according to this exemplary embodiment, since a quaternary ammonium base-containing polymer having a constituent unit expressed by Chemical Formula I is included in the toner particles, the fluidity of the liquid developer is improved and the operability is thus improved.

Although the reason is not clear, it is thought that the solubility in the carrier liquid is lowered due to the quaternary ammonium base-containing polymer, whereby a viscosity-decreasing effect is obtained and thus the fluidity of the liquid developer increases.

Due to the quaternary ammonium base-containing polymer, the grindability of the toner particles in the carrier liquid is improved, thereby enhancing the productivity.

Although the reason is not clear, it is thought that the grindability of the toner particles is improved by including the quaternary ammonium base-containing polymer which has a molecular weight smaller than that of the styrene-based thermoplastic elastomer or the styrene-based thermoplastic resin, or the solubility in other resins is locally lowered due to a salt structure of the quaternary ammonium base-containing polymer and the salt structure serves as grinding points to improve the grindability.

In the related art, the quaternary ammonium base-containing polymer might be included in toner particles of a dry developer, but the addition of the quaternary ammonium base-containing polymer to the dry toner is intended to give positive chargeability to toner and the quaternary ammonium base-containing polymer is included as a so-called charge-controlling agent. In liquid developer, since charge is not given to toner by frictional charging, it is not expected to give the positive chargeability based on the quaternary ammonium base-containing polymer. Since a carrier liquid is not present in the dry developer, there is no problem in fluidity.

In the liquid developer according to this exemplary embodiment, it is preferable that the carrier liquid further include at least one compound selected from (1) and (2): (1) a copolymer that has a monomer which can form a polymer soluble in the carrier liquid and a maleic anhydride as a constituent unit, that is a reaction product of a primary amino compound or a reaction product of a primary amino compound and a secondary amino compound, and that has a semi-maleic acid amide component and a maleinimide component as a repeating unit in the structure thereof; and (2) a metal soap.

By causing the carrier liquid to further include at least one compound selected from the copolymer of (1) and the metal soap of (2), the fluidity of the liquid developer is further improved, thereby improving the operability.

Although the reason is not clear, it is thought that since the toner particles are charged by the addition of the above-mentioned compound and the toner particles repels each other, the dispersibility is improved to achieve a viscosity-decreasing effect and the fluidity of the liquid developer is enhanced.

Hereinafter, the constituent components of the liquid developer according to this exemplary embodiment will be described in detail.

Toner Particles

Styrene-Based Thermoplastic Resin

Examples of the styrene-based thermoplastic resin included in the toner particles according to this exemplary embodiment include polymers of a styrene-based monomer and vinyl-based copolymers including a styrene-based monomer and an ester (meth)acrylate-based monomer as a constituent unit. "(meth)acryl" means one or both of acryl and methacryl.

Examples of the styrene-based monomer include styrene, o-methylstyrene, m-methylstryene, p-methylstryene, α-methylstryene, p-ethylstyrene, 2,4-dimethylstryene, p-n-butylstyrene, p-ter-butylstyrene, p-n-hexylstyrene, p-n-octylstyrene, p-n-dodecylstyrene, p-methoxystyrene, p-phenylstyrene, p-chlorostyrene, and 3,4-dichlorostyrene.

Examples of the ester (meth)acrylate-based monomer include 2-chloroethyl acrylate, phenyl (meth)acrylate, α-chloromethyl acrylate, 2-hydroxyethyl (meth)acrylate, 2-hydroxypropyl (meth)acrylate, 2-hydroxybutyl (meth) acrylate, glycidyl (meth)acrylate, dimethylaminoethyl methacrylate, diethylaminoethyl methacrylate, bis-glycidyl methacrylate, polyethylene glycol dimethacrylate, and methacryloxyethyl phosphate, in addition to alkylesters of (meth)acrylate such as methyl (meth)acrylate, ethyl (meth) acrylate, propyl (meth)acrylate, n-butyl (meth)acrylate, isobutyl (meth)acrylate, n-octyl (meth)acrylate, dodecyl (meth)acrylate, 2-ethylhexyl acrylate, and stearyl (meth) acrylate. Among these, methyl methacrylate, ethyl (meth) acrylate, propyl (meth)acrylate, n-butyl (meth)acrylate, and 2-ethylhexyl acrylate may be suitably used.

Examples of vinyl monomers other than the styrene-based monomer and the ester (meth)acrylate-based monomer include acrylic acids such as acrylic acid, methacrylic acid, α-ethyl acrylate, and crotonic acid and α- or β-alkyl derivatives thereof; unsaturated dicarboxylic acids such as fumaric acid, maleic acid, citraconic acid, and itaconic acid and monoester derivatives or diester derivatives thereof; and mono(meth)acryloyloxyethylester succinate, (meth)acrylonitrile, and acrylamide. Cross-linkable monomers having two or more double bonds may be used as the monomer if necessary. Examples of the cross-linkable monomer include aromatic divinyl compounds such as divinylbenzene and divinylnaphthalene; diacrylate compounds such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyoxyethylene(2)-2,2-bis(4-hydroxyphenyl) propane diacrylate, and polyoxyethylene(4)-2,2-bis(4-hydroxyphenyl)propane diacrylate and methacrylate compounds thereof; and polyfunctional cross-linkable monomers such as pentaerythritol triacrylate, trimethylolethane triacrylate, trimethylolpropane triacrylate, and tetramethylolmethane tetraacrylate and methacrylate compounds thereof.

The weight-average molecular weight (Mw) of the vinyl-based polymer is preferably in the range of from 150,000 to 500,000. The molecular weight distribution (Mw/Mn) of the vinyl-based polymer is preferably in the range of from 2 to 20. The vinyl-based polymer may have plural peaks or shoulders in a molecular weight distribution measured through the use of gel permeation chromatography (GPC).

The content of the styrene-based thermoplastic resin in the toner particles is preferably in the range of from 50 mass % to 95 mass % with respect to the entire binder resin and more preferably in the range of from 60 mass % to 90 mass %.

Styrene-Based Thermoplastic Elastomer

Examples of the styrene-based thermoplastic elastomer included in the toner particles according to this exemplary embodiment include block copolymers of polystyrene and polyolefin and random copolymers thereof. The styrene-based thermoplastic elastomer is a material that has a rubber characteristic at a normal temperature (20° C.) but that is softened at a high temperature like a thermoplastic plastic.

For example, a double bond remains in the form of 1-4 bodies or 1-2 bodies in polystyrene-polybutadiene-polystyrene block copolymer, polystyrene-polybutadiene/butylene-polystyrene block copolymer, polystyrene-polyethylene/butylene-polystyrene block copolymer, polystyrene-polyisoprene-polystyrene block copolymer, polystyrene-hydrogenated polybutadiene-polystyrene block copolymer, polystyrene-hydrogenated polyisoprene-polystyrene block copolymer, polystyrene-hydrogenated poly(isoprene/butadienes)-polystyrene block copolymer, and styrene-butadiene block copolymer and such copolymers may be used after hydrogenation of their double bond. Block copolymers in which a polar group is introduced into a soft segment part intervened between polystyrenes may be used. In the examples of the copolymer, parts before and after "-" mean block polymers and parts before and after "/" mean that they may be random or block.

Examples of commercial products thereof include TAFTEC M1911, TAFTEC M1943, TAFTEC MP10, ASAPRENE T439, and TAFPRENE A made by Asahi Kasei Corporation and DYNARON 8630P made by Kuraray Co., Ltd. Particularly, SOE-L611, SOE-L611X, and SOE-L605 (product names), made by Asahi Kasei Corporation, in which the soft segment part intervened between polystyrenes has a polar group introduced therein and is hydrogenated are suitably used.

The content of the styrene-based thermoplastic elastomer in the toner particles is preferably equal to or more than 5 mass % with respect to the entire binder resin. The upper limit of the content of the styrene-based thermoplastic elastomer is not particularly defined, but is preferably equal to or less than 50 mass % with respect to the entire binder resin and more preferably equal to or less than 40 mass % with respect to the entire binder resin, in consideration of the content of the styrene-based thermoplastic resin.

The absorption ratio of the styrene-based thermoplastic elastomer for the carrier liquid at 25° C. is preferably equal to or less than 200%. The absorption ratio of the styrene-based thermoplastic elastomer for the carrier liquid at 25° C. is more preferably in the range of from 0% to 150% and still more preferably in the range of from 5% to 100%.

The absorption ratio is a value obtained by inputting 2 g of thermoplastic elastomer pellets into a 200 ml beaker containing 100 ml of paraffin oil, leaving the beaker in a constant-temperature unit of 25° C. for 15 hours, filtering the resultant with a metallic gauze of 200 meshes, absorbing surplus oil from the filtered pellets by the use of filter paper, measuring an increase in weight, and calculating the following expression.

Absorption Ratio (%)=(Increase in Weight/Initial Weight of Dry Pellets)×100

Quaternary Ammonium Base-Containing Polymer

The quaternary ammonium base-containing polymer in this exemplary embodiment includes the constituent unit expressed by Chemical Formula I and preferably includes the constituent unit in the range of from 1 mass % to 50 mass %.

The quaternary ammonium base-containing polymer preferably includes one or two selected from styrene-acryl monomers such as styrene or substitutes thereof, acrylates, ester acrylates, methacrylates, ester methacrylates, and acrylonitrile in the range of from 50 mass % to 99 mass %.

Specific examples thereof include ester (meth)acrylate, amide (meth)acrylate, or copolymers of styrene-based compounds, which preferably has a quaternary ammonium base structure in a side chain and more preferably has a (meth) acryloyl group in a side chain.

Specific examples of the quaternary ammonium base-containing polymer are as follows.

(a) Quaternary ammonium salt which is a copolymer of N,N-dialkylaminoalkyl ester (meth)acrylate/other ester (meth)acrylate and styrene (b) Quaternary ammonium salt which is a copolymer of N,N-dialkylaminoalkyl (meth)acrylamide/other ester (meth) acrylate and styrene (c) Quaternary ammonium salt which is a copolymer of N,N-dialkylaminoalkyl ester (meth)acrylate/other ester (meth)acrylate and styrene In the quaternary ammonium base-containing polymer having the constituent unit expressed by Chemical Formula I, $R^1$ represents hydrogen or an alkyl group with a carbon number equal to or less than 3, $R^2$ represents an alkylene group with a carbon number equal to or less than 18, and $R^3$ to $R^5$ represent an alkyl group or an aralkyl group with a carbon number equal to or less than 18.

Here, the alkyl group and the alkylene group are independently a straight-chain, branched-chain, or cyclic aliphatic hydrocarbon group. Examples of the alkyl group preferably include methyl, ethyl, n- and iso-propyls, n-, sec-, iso-, and tert-butyls, n- sec-, iso-, and tert-amyls, n-, sec-, iso-, tert-hexyls, and n-, sec-, iso, tert-octyls, n-, sec-iso-, and tert-nonyls. Examples of the alkylene group preferably include straight-chain or branched-chain groups with a carbon number of 2 to 3, such as ethylene and propylene. The aralkyl group means a lower alkyl group substituted with an aryl group and specific examples thereof include a benzyl group, a phenylethyl group, a phenylpropyl group, a naphthylmethyl group, and a naphthylethyl group.

The quaternary ammonium base-containing polymer may not have a function of a charge-controlling agent.

The weight-average molecular weight is preferably in the range of from 2,000 to 100,000 and more preferably in the range of from 5,000 to 20,000.

The weight-average molecular weight is measured through the use of the gel permeation chromatography (GPC).

Representative examples of the quaternary ammonium base-containing polymer having the constituent unit expressed by Chemical Formula I include FCA-207P and FCA-201PS made by Fujikura Kasei Co., Ltd. but the quaternary ammonium base-containing polymer is not limited to these examples.

The content of the quaternary ammonium base-containing polymer having the constituent unit expressed by Chemical Formula I in the toner particles is preferably in the range of from 1 mass % to 30 mass % with respect to the entire binder resin and more preferably in the range of from 5 mass % to 15 mass %.

Other Additives

The toner particles according to this exemplary embodiment may further include other additives such as other binder resins, colorant, wax, a charge-controlling agent, silica powder, and metal oxides if necessary, in addition to the styrene-based thermoplastic elastomer and the styrene-based thermoplastic resin. These additives may be intercalated by kneading the additives with a binder resin including the styrene-based thermoplastic elastomer and the styrene-based thermoplastic resin, or may be external added by performing a mixing process after toner is obtained as particles. The additives normally include a colorant, but may not include a colorant when it is intended to produce a transparent toner.

Examples of the binder resin other than styrene-based thermoplastic elastomer and the styrene-based thermoplastic resin included in the toner particles include known binder resins. Specific examples thereof include polyester, polyethylene, polypropylene, polyurethane, an epoxy resin, a silicone resin, polyamide, and a denatured rosin.

Known pigments or dyes are used as the colorant. Specifically, the following pigments of yellow, magenta, cyan, and black are used.

As the yellow pigment, compounds such as a condensed azo compound, an isoindolinone compound, an anthraquinone compound, an azo metal complex compound, a methine compound, and an arylamide compound are used.

As the magenta pigment, a condensed azo compound, a diketo-pyrrolo-pyrrole compound, an anthraquinone, a quinacridone compound, a basic dye lake compound, a naphthol compound, a benzimidazolone compound, a thioindigo compound, and a perylene compound are used.

As the cyan pigment, a copper phthalocyanine compound and derivatives thereof, an anthraquinone compound, a basic dye lake compound, and the like are used.

As the black pigment, carbon black, aniline black, acetylene black, iron black, and the like are used.

The wax is not particularly limited and examples thereof include vegetable waxes such as carnauba wax, tallow, and rice wax; animal waxes such as bees wax, insect wax, whale wax, and wool wax; mineral waxes such as montan wax and ozokerite; synthetic fatty acid solid ester waxes such as Fischer-Tropsch wax (FT wax) having ester in a side chain, special fatty acid ester, and poly-valent alcohol ester; and synthetic waxes such as paraffin wax, polyethylene wax, polypropylene wax, polytetrafluoroethylene wax, polyamide wax, and silicone compounds. These waxes may used singly or in combination of two or more thereof.

The charge-controlling agent is not particularly limited and known charge-controlling agents may be used. Examples thereof include positively-chargeable charge-controlling agents such as a nigrosine dye, a fatty acid-denatured nigrosine dye, a carboxyl group-containing fatty acid-denatured nigrosine dye, a quaternary ammonium salt, amine compounds, amide compounds, imide compounds, and organic metal compounds; and negatively-chargeable charge-controlling agents such as metal complexes of oxycarboxylic acid, metal complexes of azo compounds, metal complex dyes, and salicylic acid derivatives. The charge-controlling agents may be used singly or in combination of two or more thereof.

The metal oxide is not particularly limited, and examples thereof include titanium oxide, aluminum oxide, magnesium oxide, zinc oxide, strontium titanate, barium titanate, magnesium titanate, and calcium titanate. The metal oxides may be used singly or in combination of two or more thereof.

Method of Producing Toner Particles

The method of producing the toner particles used in this exemplary embodiment is not particularly limited, and the toner particles may be obtained, for example, by pulverizing pulverized toner, in-solution emulsified and dried toner, or toner produced through the use of a polymerized toner producing method in a carrier liquid.

For example, pulverized toner is obtained by inputting and mixing the binder resin including the styrene-based thermoplastic elastomer and the styrene-based thermoplastic resin, the quaternary ammonium base-containing polymer, the colorant, and other additives to a mixer such as a Henschel mixer, melting and kneading the mixture by the use of a biaxial extruder, a Banbury mixer, a roll mill, a kneader, and the like, cooling the obtained product by the use of a drum flaker or the like, coarsely pulverizing the product by the use of a pulverizer such as a hammer mill, and further pulverizing the product by the use of a pulverizer such as a jet mill, and then classifying the product by the use of a wind classifier or the like.

An in-solution emulsified and dried toner is obtained by melting the binder resin including the styrene-based thermoplastic elastomer and the styrene-based thermoplastic resin, the quaternary ammonium base-containing polymer, the colorant, other additives, and the like in a solvent such as ethyl acetate, emulsifying/suspending the resultant in a solution to which a dispersion stabilizer such as calcium carbonate is added, removing the solvent, and filtering and drying the particles obtained by removing the dispersion stabilizer.

The polymerized toner is obtained by adding a composition including the polymerizable monomer forming the binder resin, the quaternary ammonium base-containing polymer, the colorant, a polymerization initiator (such as benzoyl peroxide, lauroyl peroxide, isopropylperoxy carbonate, cumene hydroperoxide, 2,4-dichlorobenzoyl peroxide, and methylethylketone peroxide), other additives, and the like in an aqueous phase under agitation, granulating the resultant, performing a polymerization reaction, and filtering and drying the particles.

In the above-mentioned production method, the quaternary ammonium base-containing polymer may be added after it is melted in a thermoplastic resin in advance.

The blending ratio of the materials (such as the styrene-based thermoplastic elastomer and the styrene-based thermoplastic resin, the colorant, and other additives) for obtaining the toner is freely set. The toner particles for the liquid developer according to this exemplary embodiment are obtained by pulverizing the obtained toner in a carrier oil by the use of a known pulverizer such as a ball mill, a beads mill, and a high-pressure wet atomizing unit.

The volume-average particle diameter D50v of the toner particles is preferably in the range of from 0.5 μm to 5.0 μm. The volume-average particle diameter D50v of the toner particles is more preferably in the range of from 0.8 μm to 4.0 μm and still more preferably in the range of from 1.0 μm to 3.0 μm.

The volume-average particle diameter D50v, the number-average particle size distribution index (GSDp), the volume-average particle size distribution index (GSDv), and the like of the toner particles are measured through the use of a laser diffraction/scattering type particle size distribution measuring instrument such as LA920 (made by Horiba Ltd.). As for each particle size range (channel) into which the particle size is divided on the basis of the particle size distribution, the cumulative distributions of the volume and the number are drawn from the small diameter side and the particle diameter when the cumulative value is 16% is defined as the volume D16v and the number D16p, the particle diameter when the cumulative value is 50% is defined as the volume D50v and the number D50p, and the particle diameter when the cumulative value is 84% is defined as the volume D84v and the number D84p. The volume-average particle size distribution index (GSDv) is calculated as $(D84v/D16v)^{1/2}$ and the number-average particle size distribution index (GSDp) is calculated as $(D84p/D16p)^{1/2}$, using the above definitions.

Carrier Liquid

The carrier liquid is an insulating liquid used to disperse the toner particles and is not particularly limited, but examples thereof include aliphatic hydrocarbon solvents (MORESCO WHITE MT-30P, MORESCO WHITE P40, and MORESCO WHITE P70 made by Matsumura Oil Co., Ltd. and ISOPA L and ISOPA M made by Exxon Chemicals Inc. as commercial products) such as paraffin oil and hydrocarbon solvents (EXXSOL D80, EXXSOL D110, and EXXSOL D130 made by Exxon Chemicals Inc. and NAPHTESOL L, NAPHTESOL M, NAPHTESOL H, NEW NAPHTESOL 160, NEW NAPHTESOL 200, NEW NAPHTESOL 220, and NEW NAPHTESOL MS-20P made by Nippon Petro Chemicals Co., Ltd. as commercial products) such as naphthene oils. An aromatic compound such as toluene may be included therein.

The carrier liquid included in the liquid developer according to this exemplary embodiment may be one kind or two or more kinds. When a mixture of two or more kinds is used as the carrier liquid, a mixture of a paraffin solvent and a vegetable oil or a mixture of a silicone solvent and a vegetable oil may be used and the mixture of a paraffin solvent and a vegetable oil is preferably used.

The carrier liquid used in this exemplary embodiment preferably includes the paraffin oil as a major component. Here, a "major component" is a component of which content is the most among the components of the carrier liquid and is preferably equal to or more than 50 vol %.

A specific copolymer expressed by the following (1) or a metal soap expressed by the following (2) may be added to the carrier liquid.

Specific Copolymer

A compound expressed by the following (1) is preferably included in the carrier liquid according to this exemplary embodiment:

(1) A copolymer (hereinafter, also referred to as "specific copolymer") that has a monomer which may form a polymer soluble in the carrier liquid and a maleic anhydride as a constituent unit, that is a reaction product of a primary amino compound or a reaction product of a primary amino compound and a secondary amino compound, and that has a semi-maleic acid amide component and a maleinimide component as a repeating unit in the structure thereof.

The specific copolymer is preferably at least a three-membered copolymer including a copolymer having a semi-maleic acid amide component and a maleinimide component and a polymer component giving solubility in the carrier liquid thereto.

Examples of the monomer of the polymer giving the solubility include alkenes, cycloalkenes, styrenes, vinylethers, allyl ethers, ester carboxylates, and ester acrylates.

More specifically, examples of the monomer of the polymer giving the solubility include optionally substituted alkenes with a total carbon number of 3 to 40 (such as propenylene, butene, vinylidene chloride, m-phenyl-1-propene, allyl alcohol, hexene, 2-ethylhexene, decene, dodecene, tetradecene, hexadecane, octadecene, docosen, eicosen, and 10-hexyl undecenoate), cycloalkenes with a total carbon number of 5 to (such as cyclopentene and cyclohexene, bicyclo[2.2.1]-heptene-2,5-cyanobicyclo[2.2.1]-heptene-2), optionally substituted styrenes with a total carbon number of to 40 (such as 4-ethylstyrene, 4-butylstyrene, 4-n-octylstyrene, and 4-hexyloxystyrene), aliphatic group-substituted vinylethers or allyl ethers with a total carbon number of 1 to 40 (examples of the aliphatic group include alkyl groups which may be substituted (such as methyl, ethyl, butyl, hexyl, octyl, decyl, dodecyl, hexadecyl, octadecyl, docosanyl, 2-ethylhexyl, and 4-methoxybutyl), aralkyl groups which may be substituted (such as benzyl and phenethyl), cycloalkyl groups which may be substituted (such as cyclopentyl and cyclohexyl), and alkenyl groups which may be substituted (such as 2-pentenyl, 4-propyl-2-pentenyl, oleyl, and linoleyl)), optionally substituted aromatic group-substituted vinylethers or allyl ethers with a total carbon number of 6 to 40 (such as phenyl, 4-buthoxyphenyl, and 4-octylphenyl as the aromatic group), vinylesters or allyl esters of optionally substituted aliphatic carboxylic acid with a total carbon number of 2 to 40 (such as esters of acetic acid, valeric acid, caproic acid, capric acid, lauric acid, myristic acid, oleic acid, sorbic acid, linoleic acid, and the like), vinylesters or allyl esters of aromatic carboxylic acid with a total carbon number of 6 to 40 (such as esters of benzoic acid, 4-butyl benzoic acid, 4-hexyl benzoic acid, and the like), and optionally substituted aliphatic esters of unsaturated carboxylic acids such as acrylic acid, methacrylic acid, maleic acid, and crotonic acid, with a total carbon number of 1 to 32 (such as methyl, ethyl, propyl, hexyl, decyl, 2-hydroxyethyl, and N,N-dimethylaminoethyl).

Specific examples of copolymers (intermediate of the specific copolymer) of these monomers and maleic anhydride will be described below, but the intermediate is not limited to the following compounds.

(1)

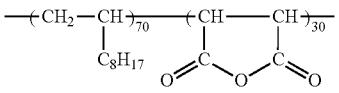

(2)

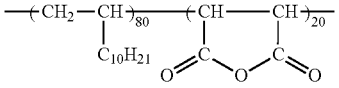

-continued (3)

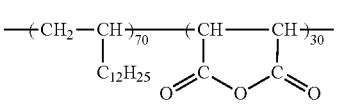

(4)

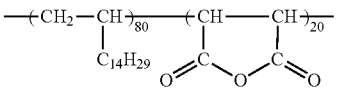

(5)

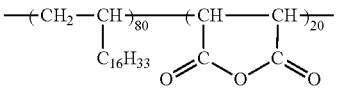

(6)

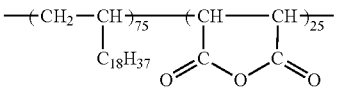

(7)

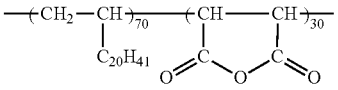

(8)

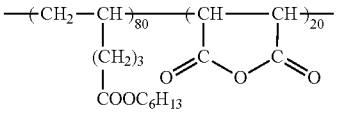

(9)

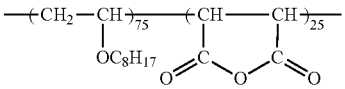

(10)

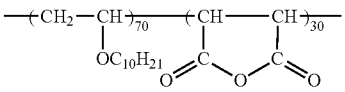

(11)

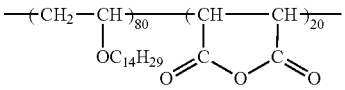

(12)

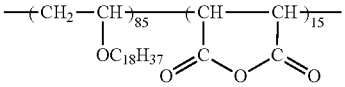

(13)

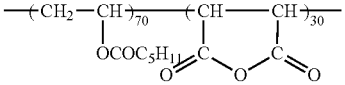

(14)

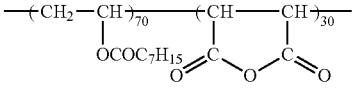

(15)

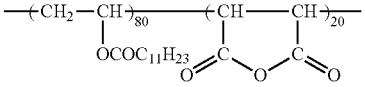

(16)

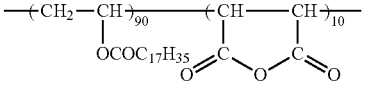

(17)

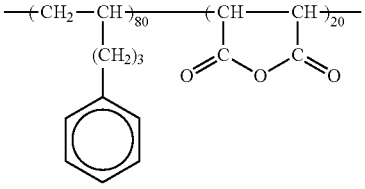

-continued (18)

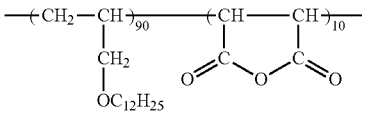

(19)

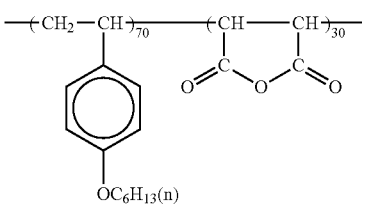

(20)

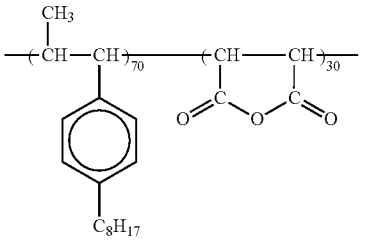

(21)

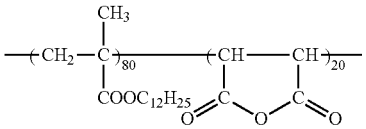

As described above, the copolymer including maleic anhydride may be produced through the use of the known methods. For example, it is described in detail in "Modern Industrial Chemistry Vol. 16, Polymer Industrial Chemistry I First Half", edited by Ryohei Oda, page 281, (published by Asakura Publishing Co., Ltd.), "Polymer Handbook 2$^{nd}$. Edition", written by J. Brandrup et al., John Wiley & Sons, New York, Known Literatures of Review Citations of Chapter 2, and the like.

The specific copolymer in this exemplary embodiments is a reaction product of the copolymer including the maleic acid and an amino compound, and a primary amino compound expressed by Chemical Formula A, or a primary amino compound expressed by Chemical Formula A and a secondary amino compound expressed by Chemical Formula B are used as the amino compound.

$R^1NH_2$ Chemical Formula A $NH(R^1)(R^2)$ Chemical Formula B

In the formulas, $R^1$ and $R^2$ represent an aliphatic group, an alicyclic hydrocarbon group, an aromatic group, or a heterocyclic group and $R^1$ and $R^2$ in Chemical Formula B may be equal to or different from each other or may be bonded to form a cycle.

Examples of $R^1$ and $R^2$ include optionally substituted alkyl groups with a carbon number of 1 to 32 (such as methyl, ethyl, butyl, hexyl, octyl, decyl, dodecyl, hexadecyl, octadecyl, docosanyl, 2-ethylhexyl, 4-butoxybutyl, and N,N-dibutylaminopropyl), optionally substituted alkenyl groups with a carbon number of 3 to 32 (such as allyl, 2-pentenyl, 4-propyl-2-pentenyl, decenyl, oleyl, and linoleyl), optionally substituted aralkyl groups with a carbon number of 7 to 36 (such as benzyl and phenethyl), optionally substituted alicyclic hydrocarbon groups with a carbon number of 5 to 32 (such as cyclopentyl, cyclohexyl, bicycle[2.2.1]-heptyl, cyclohexenyl), aryl groups which may be substituted with a carbon number of 6 to 38 (such as phenyl, tolyl, 4-butylphenyl, 4-decylphenyl, and 4-butoxyphenyl), and heterocyclic groups with a carbon number equal to or more than 5 (such as furyl and thienyl). In Chemical Formula B, $R^1$ and $R^2$ may be ring-closed with a carbon atom or may include a hetero atom in a ring (for example, morpholyl).

Examples of the amino compound include ethylamine, propylamine, butylamine, pentylamine, hexylamine, octylamine, decylamine, dodecylamine, tetradecylamine, hexadecylamine, stearylamine, docosanylamine, 2-ethylhexylamine, 3,3-dimethylpentylamine, cyclohexylamine, allylamine, benzylamine, and 4-n-octylanyline, but the amino compound is not limited to these examples.

The specific copolymer in this exemplary embodiment which is a reaction product of the amino compounds and the specific copolymer intermediate includes the semi-maleic acid amide component and the maleinimide component, and this compound is produced by forming semi-maleic acid amide copolymer through a polymerization reaction of a maleic anhydride component and the primary amino compound in the polymer compound and performing a dehydrating and ring-closing reaction to change a part of the semi-maleic amide copolymer to the maleinimide component.

That is, in an organic solvent which can dissolve both carboxylic anhydride and amino compound at the below reaction temperature without causing a reaction with both [examples thereof include hydrocarbons (such as decane, ISOPA, ISOPA H, cyclohexane, toluene, and xylene), ketones (such as methylethylketone and methylisobutylketone), ethers (such as dioxane, tetrahydrofuran, and anisole), hydrocarbon halides (such as chloroform, dichloroethylene, and methylchloroform) dimethylformamide, and dimethylsulfoxide, and these may be used singly or in combination of two or more thereof], the compounds are mixed and made to react in the temperature range of from 60° C. to 200° C. and preferably in the temperature range of from 100° C. to 180° C. for 1 hour to 80 hours and preferably for 3 hours to 15 hours. This reaction is promoted by using an organic base or an inorganic acid or an organic acid by a catalyst quantity. A normal dehydrating agent may be used together. The reaction product obtained through this reaction is a polymer compound including the semi-maleic acid amide component and the maleinimide component, and the mass ratio of the semi-maleic acid amide component and the maleinimide component is preferably in the range of from 10:90 to 90:10 and more preferably in the range of from 30:70 to 70:30.

The mass ratio of a monomer part which may form a polymer soluble in the carrier liquid and a maleic anhydride part which constitute the specific copolymer is preferably in the range of from 10:90 to 99.5:0.5 and more preferably in the range of from 30:70 to 70:30.

The molecular weight of the specific copolymer is preferably in the weight-average range of from 1,000 to 300,000 in terms of polystyrene through the GPO method and more preferably in the range of from 3,000 to 100,000.

Examples of the specific copolymer include a reaction product of the compound (1) and n-octadecylamine as an intermediate, a reaction product of the compound (2) and n-hexadecylamine as an intermediate, a reaction product of the compound (4) and n-octylamine as an intermediate, and a reaction product of the compound (5) and 2-ethylhexylamine as an intermediate, but the specific copolymer is not limited to these examples.

The content of the specific copolymer in the carrier liquid is preferably in the range of from 0.01 mass % to 10 mass % with respect to the total carrier liquid and more preferably in the range of from 0.05 mass % to 1.0 mass %.

Metal Soap

In this exemplary embodiment, the carrier liquid preferably includes (2) the metal soap.

Metal soaps soluble in the carrier liquid of the liquid developer may be used as the metal soap. The metal soap means a compound in which a cationic component is mono-valent or poly-valent metal component and an anionic component is expressed by an organic acid component.

Examples of the metal constituting the metal soap include magnesium, calcium, strontium, barium, aluminum, gallium, titanium, zirconium, chromium, molybdenum, manganese, iron, cobalt, nickel, copper, zinc, tin, lead, cadmium, and silver.

Examples of the acid constituting the metal soap include organic acids having an acidic group such as carboxylic acid, alkyl sulfate, sulfonic acid, and ester phosphate. Examples of the carboxylic acid include carboxylic acids with a carbon number of 6 to 24. Specific Examples thereof include caproic acid, caprylic acid, 2-ethylhexanoic acid (octenoic acid), capric acid, lauric acid, tridecylic acid, myristic acid, pentadecylic acid, palmitic acid, margaric acid, stearic acid, 12-hydroxy stearate, oleic acid, linoleic acid, naphthenic acid, resin acid, alkyl phthalate, and alkyl salicylate. Examples of the alkyl sulfate include alkyl sulfate ester with a carbon number of 12 to 20. Examples of the sulfonic acid include alkylbenzene sulfonate such as dodecylbenzene sulfonate and octadecyl benzene sulfonate and petroleum sulfonate. Examples of the ester phosphate include mono- or dialkylphosphate ester with a carbon number of 8 to 20.

Preferable examples of the metal soap include iron naphthenate, manganese naphthenate, nickel naphthenate, cobalt naphthenate, zirconium naphthenate, iron octenoic acid, cobalt octenoic acid, nickel octenoic acid, zirconium octenoic acid, aluminum tristearate, lead stearate, manganese oleate, copper oleate, lead resinate, barium petroleum acid, and manganese salt of 2-ethylhexylsulfo succinate, but the metal soap is not limited to these examples.

The content of the metal soap in the carrier liquid is preferably in the range of from 0.01 mass % to 10 mass % with respect to the total content of the carrier liquid and more preferably in the range of from 0.05 mass % to 1.0 mass %.

In addition, the carrier liquid may further include various subsidiary materials such as a dispersant, an emulsifier, a surfactant, a stabilizer, a moisturizer, a thickener, a frothing agent, an antifoamer, a coagulant, a gellant, an antisettling agent, a charge-controlling agent, an antistatic agent, an anti-aging agent, a softener, a plasticizer, a filler, an odorant, an anti-adhesive agent, and a release agent.

Method of Producing Liquid Developer

The liquid developer according to this exemplary embodiment may be obtained by mixing and pulverizing the toner particles and the carrier liquid, for example, through the use of a disperser such as a ball mill, a sand mill, an atritor, and a bead mill and dispersing the toner particles in the carrier liquid.

The dispersion of the toner particles in the carrier liquid is not limited to the disperser, but may be performed by a special agitating blade at a high speed like a mixer, or may be performed with a shearing force of a rotor and stator known as a homogenizer, and or may be performed by the use of ultrasonic waves.

The concentration of the toner particles in the carrier liquid is preferably in the range of from 0.5 mass % to 40 mass % and more preferably in the range of from 1 mass % to 30 mass %.

Thereafter, the obtained dispersion may be filtered, for example, by the use of a membrane filter with a hole diameter of 100 μm to remove waste and coarse particles.

Process Cartridge, Image Forming Apparatus and Image Forming Method

An image forming apparatus according to this exemplary embodiment includes an electrostatic latent image holding member (hereinafter, also referred to as a "photosensitive member"), a charging device that charges the surface of the electrostatic latent image holding member, an electrostatic latent image forming device that forms an electrostatic latent image on the surface of the electrostatic latent image holding member, a developing device that contains the liquid developer according to this exemplary embodiment and that develops an electrostatic latent image formed on the surface of the electrostatic latent image holding member with the liquid developer to form a toner image, and a transfer device that transfers the toner image to a recording medium. The image forming apparatus may further include a fixing device that fixes the toner image to the recording medium. The liquid developer supplied to the developing device may be supplied from a developer cartridge accommodating the liquid developer and being detachable from the image forming apparatus.

In the image forming apparatus, for example, the part including the developing device may have a cartridge structure (process cartridge) that is detachable from the image forming apparatus body. A process cartridge that accommodates the liquid developer, that includes a developing device developing the electrostatic latent image formed on the electrostatic latent image holding member with the liquid developer to form a toner image, and that is detachable from the image forming apparatus is suitably used as the process cartridge.

The image forming apparatus employing the liquid developer according to this exemplary embodiment will be described below with reference to the accompanying drawing.

FIG. 1 is a diagram schematically illustrating the configuration of an example of the image forming apparatus according to this exemplary embodiment. The image forming apparatus 100 includes a photosensitive member (the electrostatic latent image holding member) 10, a charging device 20, an exposing device (the electrostatic latent image forming device) 12, a developing device 14, an intermediate transfer member (the transfer device) 16, a cleaner 18, and a transfer and fixing roller (the transfer device) 28. The photosensitive member 10 has a cylindrical shape and the charging device 20, the exposing device 12, the developing device 14, the intermediate transfer member 16, and the cleaner 18 are sequentially arranged on the outer circumference of the photosensitive member 10.

The operation of the image forming apparatus 100 will be described below in brief.

The charging device 20 charges the surface of the photosensitive member 10 to a predetermined potential, and the exposing device 12 exposes the charged surface, for example, with a laser beam on the basis of an image signal to form an electrostatic latent image.

The developing device 14 includes a developing roller **14*a* and a developer container 14*b*. The developing roller 14*a* is disposed so that a part thereof is immersed in a liquid developer 24 contained in the developer container 14*b*. The liquid developer 24** includes a carrier liquid and toner particles including the styrene-based thermoplastic elastomer, the styrene-based thermoplastic resin, and the quaternary ammonium base-containing polymer.

The toner particles are dispersed in the liquid developer 24 and for example, the liquid developer 24 may be further stirred through the use of an stirring member disposed in the developer container 14*b*.

The liquid developer 24 supplied to the developing roller 14*a* is transported to the photosensitive member 10 in the state where the amount to be supplied is limited to be constant by a regulation member and is supplied to the electrostatic latent image at a position where the developing roller 14*a* is close to (or comes in contact with) the photosensitive member 10. Accordingly, the electrostatic latent image is developed to form a toner image 26.

The developed toner image 26 is transported by the photosensitive member 10 rotating in the direction of arrow B in the drawing and is then transferred to a sheet of paper (recording medium) 30. However, in this exemplary embodiment, the toner image is temporarily transferred to the intermediate transfer member 16 so as to improve the transfer efficiency to the recording medium including the peeling efficiency of the toner image from the photosensitive member 10 before it is transferred to the sheet of paper 30 and to fix the toner at the same time as transferring the toner image to the recording medium. At this time, a difference in circumferential speed may be formed between the photosensitive member 10 and the intermediate transfer member 16.

Subsequently, the toner image transported in the direction of arrow C by the intermediate transfer member 16 is transferred and fixed to the sheet of paper 30 at the contact position with the transfer and fixing roller 28.

The transfer and fixing roller 28 nips the sheet of paper 30 along with the intermediate transfer member 16 and brings the toner image on the intermediate transfer member 16 into close contact with the sheet of paper 30. Accordingly, the toner image is transferred to the sheet of paper 30 and the toner image is fixed to the sheet of paper to form a fixed image 29. The fixation of the toner image is preferably performed by providing a heater to the transfer and fixing roller 28 and pressurizing and heating the toner image. The fixing temperature is generally in the range of from 120° C. to 200° C.

When the intermediate transfer member 16 has a roller shape as shown in FIG. 1, the intermediate transfer member 16 and the transfer and fixing roller 28 have the configurations based on the fixing roller and the backup roller in a fixing device respectively to form a roller pair along with the transfer and fixing roller 28, whereby exhibits a fixing function. That is, when the sheet of paper 30 passes through the nip, the toner image is transferred to the sheet of paper and the sheet of paper is heated and pressurized against the intermediate transfer member 16 by the transfer and fixing roller 28. Accordingly, the binder resin of the toner particles constituting the toner image is softened and the toner image infiltrates into fibers of the sheet of paper 30, whereby a fixed image 29 is formed on the sheet of paper 30.

In this exemplary embodiment, the fixation is performed at the same time as the transfer to the sheet of paper 30, but the transfer process and the fixing process may be separated so as to perform the fixation after performing the transfer. In this case, the transfer roller transferring the toner image from the photosensitive member 10 has the function of the intermediate transfer member 16.

On the other hand, in the photosensitive member 10 having transferred the toner image 26 to the intermediate transfer member 16, the toner particles remaining after the transfer are shifted to the contact position with the cleaner 18 and are recovered by the cleaner 18. When the transfer efficiency is close to 100% and the remaining toner does not cause any problem, it is not necessary to provide the cleaner 18.

The image forming apparatus 100 may include an erasing device (not shown) neutralizing the surface of the photosensitive member 10 after the transfer and until the next charging.

The charging device 20, the exposing device 12, the developing device 14, the intermediate transfer member 16, the transfer and fixing roller 28, and the cleaner 18 included in the image forming apparatus 100 operate in synchronization with the rotating speed of the photosensitive member 10.

According to the image forming apparatus according to this exemplary embodiment, an image forming method is performed that includes: charging a surface of an electrostatic latent image holding member; forming an electrostatic latent image on the surface of the electrostatic latent image holding member; developing the electrostatic latent image formed on the surface of an electrostatic latent image holding member with the liquid developer according to claim 1 to form a toner image; and transferring the toner image to a recording medium.

EXAMPLES

This exemplary embodiment will be described below in more detail but the below examples do not limit the invention. In the following description, "%" represents "mass %", as long as it is not differently mentioned.

Example 1

Production of Liquid Developer 40 parts by mass of a cyan pigment C. I. Pigment Blue 15:3 (made by Clariant International Inc.) is added to 60 parts by mass of a styrene acrylic resin (FSR-051 made by Fujikura Kasei Co., Ltd., with a weight-average molecular weight of 380,000) and the mixture is kneaded with a pressurizing kneader. The kneaded material is coarsely pulverized to produce a cyan pigment master batch.

A mixture having the following composition is melted and dispersed by the use of a ball mill for 24 hours.

The cyan pigment master batch: 25 parts by mass

Styrene acrylic resin (FSR-053 made by Fujikura Kasei Co., Ltd., with a weight-average molecular weight of 320,000 and an acid value of 10): 57 parts by mass Styrene-based thermoplastic elastomer ("SOE-L605" made by Asahi Kasei Corporation, which is a hydrogenated product of a styrene butadiene block copolymer): 13 parts by mass Quaternary ammonium base-containing polymer (FCA-207P made by Fujikura Kasei Co., Ltd., with a weight-average molecular weight of 13,000): 5 parts by mass Toluene: 900 parts by mass Then, 2000 parts by mass of methanol is input to a 5 L vessel in which a homogenizer (ULTRA-TURRAX T-25 made by IKA Co., Ltd.) is disposed and stirred at 8,000 rpm. 100 parts by mass of the mixture is dropped therein to obtain a precipitate. The obtained precipitate is filtered and dried in vacuum at 40° C. to obtain a toner base material. A mixture of 15 parts by mass of the obtained toner base material and 85 parts by mass of volatile paraffin oil (ISOPA L made by Exxon Mobile Corporation) is pulverized with a ball mill, whereby Liquid Developer 1 in which toner particles with an average particle diameter of 2.3 μm are dispersed is obtained.

Example 2

Production of Liquid Developer 40 parts by mass of a cyan pigment C.I. Pigment Blue 15:3 (made by Clariant International Inc.) is added to 60 parts by mass of a styrene acrylic resin (FSR-051 made by Fujikura Kasei Co., Ltd.) and the mixture is kneaded with a pressurizing kneader. The kneaded material is coarsely pulverized to produce a cyan pigment master batch.

On the other hand, 48 parts by mass of styrene acrylic resin (FSR-053 made by Fujikura Kasei Co., Ltd., with a weight-average molecular weight of 320,000 and an acid value of 10), 9 parts by mass of a quaternary ammonium base-containing polymer (FCA-201 PS made by Fujikura Kasei Co., Ltd.), and 200 parts by mass of ethyl acetate are dissolved for 1 hour and then dried in vacuum at 80° C.

A mixture having the following composition is kneaded by the use of a Banbury mixer.

The cyan pigment master batch: 25 parts by mass

Styrene acrylic resin including the quaternary ammonium base-containing polymer: 57 parts by mass Styrene-based thermoplastic elastomer ("SOE-L611" made by Asahi Kasei Corporation, which is a partially-hydrogenated product of a styrene butadiene block copolymer): 18 parts by mass The kneaded material is pulverized with a jet mill, whereby cyan particles with an average particle diameter of 10 μm is obtained.

85 parts by mass of refractory paraffin oil (MORESCO WHITE P40 made by Matsumura Oil Co., Ltd.) is mixed into 15 parts by mass of the cyan particles and the mixture is pulverized with a ball mill, whereby Liquid Developer 2 in which toner particles with an average particle diameter of 2.5 μm are dispersed is obtained.

Example 3

Production of Liquid Developer 40 parts by mass of a yellow pigment C.I. Pigment Yellow 185 (made by BASF Corporation) is added to 60 parts by mass of a styrene acrylic resin (FSR-053 made by Fujikura Kasei Co., Ltd.) and the mixture is kneaded with a pressurizing kneader. The kneaded material is coarsely pulverized to produce a yellow pigment master batch.

16 parts by mass of n-butylmethacrylate (made by Wako Pure Chemical Industries, Ltd.), 64 parts by mass of styrene monomer (made by Wako Pure Chemical Industries, Ltd.), and 20 parts by mass of quaternary ammonium base-containing polymer (FCA-207 P made by Fujikura Kasei Co., Ltd.) are mixed and 5 parts by mass of azobisisobutylonitrile (made by Wako Pure Chemical Industries, Ltd.) is added thereto as a polymerization initiator, whereby a mixture including the monomer and the quaternary ammonium base-containing polymer is prepared.

On the other hand, 30 parts by mass of calcium carbonate (LUMINOUS made by Maruo Calcium Co., Ltd.) and 3.5 parts by mass of carboxymethyl cellulose (SEROGEN made by Dai-Ichi Kogyo Seiyaku Co., Ltd.) are added as a dispersion stabilizer to an aqueous solution in which 28 parts by mass of sodium chloride (made by Wako Pure Chemical Industries, Ltd.) is dissolved in 160 parts by mass of deionized water, and the mixture is dispersed with a ball mill for 24 hours, whereby a dispersion medium is obtained. The mixture is input to 200 parts of the dispersion medium and is emulsified with an emulsifier (ULTRA-TURRAX T-25 made by IKA Co., Ltd.) at 24,000 rpm for 3 minutes, whereby a suspension is obtained.

Nitrogen is introduced into a separable flask including an agitator, a thermometer, a cooling tube, and a nitrogen introduction tube via the nitrogen introduction tube to make the inside of the flask into a nitrogen atmosphere. The suspension is input thereto, a reaction is made to occur at 65° C. for 3 hours, and the reaction product is heated at 70° C. for 10 hours and is then cooled. 10% hydrochloric acid solution is added to the reaction solution to decompose calcium carbonate and then solid-liquid separation is performed by a centrifugal. The obtained particles are repeatedly washed with 1 L of deionized water three times and then are dried in vacuum at 40° C., whereby a styrene acrylic resin including the quaternary ammonium base-containing polymer is obtained.

A mixture having the following composition is kneaded with a pressurizing kneader.

The yellow pigment master batch: 25 parts by mass

Styrene acrylic resin including the quaternary ammonium base-containing polymer: 55 parts by mass Styrene-based thermoplastic elastomer ("SOE-L611" made by Asahi Kasei Corporation, which is a partially-hydrogenated product of a styrene butadiene block copolymer): 20 parts by mass The kneaded material is pulverized with a jet mill, whereby yellow particles with an average particle diameter of 10 μm is obtained.

85 parts by mass of paraffin oil (MORESCO WHITE MT30P made by Matsumura Oil Co., Ltd.) is mixed into 15 parts by mass of the yellow particles and the mixture is pulverized with a ball mill, whereby Liquid Developer 3 in which toner particles with an average particle diameter of 2.6 μm are dispersed is obtained.

Example 4

Production of Specific Copolymer

Production of Intermediate

A mixture of 98 parts by mass of maleic anhydride, 378 parts by mass of 1-octadecene, and 1850 parts by mass of toluene is heated at a temperature of 90° C. while agitating the mixture in the atmosphere of nitrogen. 7.0 parts by mass of benzoyl peroxide as an initiator is added at that temperature, the mixture is stirred for 3 hours, 7.0 parts by mass of benzoyl peroxide is added, and is further stirred for 5 hours. The obtained polymer solution is cooled, is then added to 25,000 parts by mass of isopropanol in 15 minutes while stirring the mixture, and is further stirred for 1 hour. The precipitated solid is filtered and dried under depressurization, whereby 290 parts by mass of white solid is obtained.

Production of Specific Copolymer

A mixture of 43 parts by mass of the polymer (white solid) obtained through the production of an intermediate, 20 parts by mass of n-octadecylamine, 1 part by mass of pyridine, and 420 parts by mass of toluene is stirred at a temperature of 100° C. for 3 hours. After the mixture is cooled, the reaction solution is added to 8000 parts by mass of methanol in 15 minutes while stirring and is further stirred for 1 hour. The precipitated solid is filtered and is dried under depressurization, whereby 43 parts by mass of light yellowish white solid (specific copolymer) is obtained. The molecular weight measured through the use of a high-speed liquid chromatography method is 14,000. As the result of neutralization titration using a potassium hydroxide ethanol solution, the ratio of the semi-maleic acid amide component and the maleinimide component is 6:4.

Production of Liquid Developer

Yellow particles with an average particle diameter of 10 μm are obtained through the method according to Example 3. 0.1 parts by mass of the specific copolymer and 85 parts by mass of paraffin oil (MORESCO WHITE MT30P made by Matsumura Oil Co., Ltd.) are mixed into 15 parts by mass of the yellow particles and the mixture is pulverized with a ball mill, whereby Liquid Developer 4 in which toner particles with an average particle diameter of 2.5 μm are dispersed is obtained.

Example 5

Production of Liquid Developer 40 parts by mass of carbon black Reagal-330 (made by Cabot Corporation) is added to 60 parts by mass of a styrene acrylic resin (TIZ-475 made by Fujikura Kasei Co., Ltd.) and the mixture is kneaded with a pressurizing kneader. The kneaded material is coarsely pulverized to produce a black pigment master batch.

On the other hand, 52 parts by mass of styrene acrylic resin (TIZ-475 made by Fujikura Kasei Co., Ltd., with a weight-average molecular weight of 320,000 and an acid value of 10), 8 parts by mass of a quaternary ammonium base-containing polymer (FCA-201 PS made by Fujikura Kasei Co., Ltd.), and 200 parts by mass of ethyl acetate are dissolved for 1 hour and then dried in vacuum at 80° C.

A mixture having the following composition is kneaded by the use of a Banbury mixer.

The black pigment master batch: 25 parts by mass

Styrene acrylic resin including the quaternary ammonium base-containing polymer: 60 parts by mass Styrene-based thermoplastic elastomer ("ASAPRENE T-439" made by Asahi Kasei Corporation, which is a styrene butadiene block copolymer): 15 parts by mass The kneaded material is pulverized with a jet mill, whereby black particles with an average particle diameter of 10 μm are obtained.

85 parts by mass of refractory naphthene oil (Exxsol D80 made by Exxon Mobile Corporation.) is mixed into 15 parts by mass of the black particles and the mixture is pulverized with a ball mill, whereby Liquid Developer 5 in which toner particles with an average particle diameter of 2.5 μm are dispersed is obtained.

Comparative Example 1

Liquid Developer 101 is obtained in the same way as described in Example 1, except that 5 parts by mass of the quaternary ammonium base-containing polymer (FCA-207P made by Fujikura Kasei Co., Ltd., with a weight-average molecular weight of 13,000) in Example 1 is replaced with styrene-based thermoplastic resin (FSR-053 made by Fujikura Kasei Co, Ltd.). The volume-average particle diameter of the toner particles in the carrier liquid is 3.4 μm.

Comparative Example 2

Liquid Developer 102 is obtained in the same way as described in Example 1, except that the styrene-based thermoplastic resins (FSR-053 made by Fujikura Kasei Co., Ltd. and FSR-051 made by Fujikura Kasei Co., Ltd.) in Example 1 are replaced with the styrene-based thermoplastic elastomer ("SOE-L605" made by Asahi Kasei Co., Ltd., which is a hydrogenated product of a styrene butadiene block copolymer). The volume-average particle diameter of the toner particles in the carrier liquid is 5.2 μm.

Comparative Example 3

Liquid Developer 103 is obtained in the same way as described in Example 1, except that 13 parts by mass of the styrene-based thermoplastic elastomer ("SOE-L605" made by Asahi Kasei Co., Ltd., which is a hydrogenated product of a styrene butadiene block copolymer) in Example 1 is replaced with the styrene-based thermoplastic resin (FSR-053 made by Fujikura Kasei Co., Ltd.). The volume-average particle diameter of the toner particles in the carrier liquid is 2.5 μm.

Evaluation

—Fixability

Each of the produced liquid developers is diluted with a carrier oil so as to satisfy a concentration of 2.5% and is then input to a disperser (polystyrene). Two transparent electrodes disposed to face each other with a gap of 1 mm are immersed therein and a voltage of 300 V is applied for 30 seconds. The electrodes are taken out and the toner precipitated on the minus electrode is transferred to a sheet of J coated paper made by Fuji Xerox Co., Ltd. The amount of the precipitated toner is measured as 2 parts by mass/$m^2$.

This transferred image is fixed at a fixing speed of 500 mm/sec under Nip 6 mm by the use of an external fixing device having a pair of fixing rolls.

In order to evaluate the minimum fixing temperature as the evaluation of fixability, the fixing device is modified so that the fixing temperature can be changed, and an image is fixed while raising the fixing temperature of the fixing roll in increments of +5° C. from 100° C. A inward crease is formed at the center of a solid part of the fixed toner image in the sheet of paper on which the image is formed, the part in which the fixed toner image is destroyed is wiped with a tissue paper, the line width of a decolored part is measured, and the temperature at which the decolored line width is equal to or less than 0.5 mm is defined as the minimum fixing temperature (MFT).

In this evaluation, it is evaluated that the MFT equal to or less than 130° C. is good.

—Evaluation of Bending and Scratch

As the bending-resistance characteristic, a sheet of paper is bent in a state where an image is located inside, the bent part is lightly wiped, and then the destroyed state of the image is evaluated on the basis of the following evaluation criterion.

A: Slight and discontinuous peeling of image

B: Discontinuous destruction

C: Continuous destruction

The scratch-resistant characteristic is evaluated on the basis of the following evaluation criterion using a pressurizing force of 0.5 k parts by weight in a scratch tester made by Linax Co., Ltd.

A: Concentration decreases but image remains.

B: Some part of base are peeled.

C: Most image is peeled.

—Evaluation of Fluidity

As for fluidity, a droplet of a developer is dropped to an acryl plate tilted by 35 degrees with a spoid and the distance the developer flows for 30 seconds is measured and evaluated. The evaluation criterion is as follows.

A: Equal to or more than 50 mm

B: Less than 50 mm and equal to or more than 20 mm

C: Less than 20 mm and equal to or more than 5 mm

D: Less than 5 mm

—Evaluation of Grindability

As for grindability, a toner base material and a carrier oil are injected into a ball mill, the mixture is pulverized with glass beads of 5 mmϕ, and the time for the particle size to be equal to or less than 3 μm is measured and evaluated. The evaluation criterion is as follows.

A: Equal to or less than 10 hours

B: More than 10 hours and equal to or less than 20 hours

C: More than 20 hours and equal to or less than 40 hours

D: More than 40 hours

TABLE 1

| | Developer No. | Binder Resin (%) Thermo plastic elastomer | Styrene-based thermo plastic resin | Quaternary ammonium base-containing polymer | Type of carrier liquid | Evaluation MFT (° C.) | Bending | Scratch | Fluidity | Grindability |
|---|---|---|---|---|---|---|---|---|---|---|
| Ex. 1 | 1 | 14 | 80 | 6 | paraffin | 120 | A | A | B | B |
| Ex. 2 | 2 | 20 | 70 | 10 | paraffin | 120 | A | B | B | A |
| Ex. 3 | 3 | 22 | 66 | 12 | paraffin | 120 | A | B | B | A |
| Ex. 4 | 4 | 22 | 66 | 12 | paraffin | 120 | A | B | A | A |
| Ex. 5 | 5 | 17 | 74 | 9 | naphthene | 130 | B | B | B | B |
| Com. Ex. 1 | 101 | 14 | 86 | 0 | paraffin | 160 | B | B | D | D |
| Com. Ex. 2 | 102 | 90 | 0 | 10 | paraffin | 140 | B | C | D | D |
| Com. Ex. 3 | 103 | 0 | 90 | 10 | paraffin | 140 | C | B | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid; and toner particles that are dispersed in the carrier liquid and that include a styrene-based thermoplastic elastomer, a styrene-based thermoplastic resin, and a quaternary ammonium base-containing polymer having a constituent unit expressed by Chemical Formula I:

Chemical Formula I

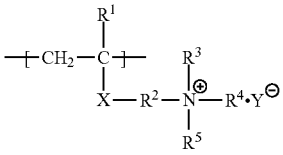

wherein $R^1$ represents hydrogen or an alkyl group with a carbon number equal to or less than 3, $R^2$ represents an alkylene group with a carbon number equal to or less than 18, $R^3$ to $R^5$ represent an alkyl group or an aralkyl group with a carbon number equal to or less than 18, X represents —COO— or —CONH—, and $Y^-$ represents a halogen ion or an anion having a —COO— group or a —$SO_3$— group in the structure thereof.

2. The liquid developer according to claim 1, wherein the carrier liquid includes at least one kind of compound selected from (1) and (2):

(1) a copolymer that has a monomer which can form a polymer soluble in the carrier liquid and a maleic anhydride as a constituent unit, that is a reaction product of a primary amino compound, or a reaction product of a primary amino compound and a secondary amino compound, and that has a semi-maleic acid amide component and a maleinimide component as a repeating unit in the structure thereof; and (2) a metal soap.

3. A developer cartridge accommodating the liquid developer according to claim 1.

4. A process cartridge comprising:

a developing device that accommodates the liquid developer according to claim 1 and that develops an electrostatic latent image formed on a surface of an electrostatic latent image holding member with the liquid developer to form a toner image, wherein the process cartridge is detachable from an image forming apparatus.

5. An image forming apparatus comprising:

an electrostatic latent image holding member;

a charging device that charges a surface of the electrostatic latent image holding member;

an electrostatic latent image forming device that forms an electrostatic latent image on the surface of the electrostatic latent image holding member;

a developing device that contains the liquid developer according to claim 1 and that develops an electrostatic latent image formed on the surface of the electrostatic latent image holding member with the liquid developer to form a toner image; and a transfer device that transfers the toner image to a recording medium.

6. An image forming method comprising:

charging a surface of an electrostatic latent image holding member;

forming an electrostatic latent image on the surface of the electrostatic latent image holding member;

developing the electrostatic latent image formed on the surface of an electrostatic latent image holding member with the liquid developer according to claim 1 to form a toner image; and transferring the toner image to a recording medium.

7. The liquid developer according to claim 1, wherein a content of the styrene-based thermoplastic elastomer in the toner particles is greater than or equal to 5% by mass with respect to the entire binder resin.

* * * * *